US006752273B2

(12) United States Patent
Reddoch

(10) Patent No.: US 6,752,273 B2
(45) Date of Patent: Jun. 22, 2004

(54) CUTTINGS DISPOSAL METHOD

(75) Inventor: Jeffrey Reddoch, Lafayette, LA (US)

(73) Assignee: Baker Hughes Incorporated, Houston, TX (US)

( * ) Notice: Subject to any disclaimer, the term of this patent is extended or adjusted under 35 U.S.C. 154(b) by 126 days.

(21) Appl. No.: 10/056,931

(22) Filed: Jan. 24, 2002

(65) Prior Publication Data

US 2003/0192812 A1 Oct. 16, 2003

(51) Int. Cl.[7] ..... B03B 9/00
(52) U.S. Cl. ..... 209/2; 210/768
(58) Field of Search ..... 209/2; 210/768, 210/748; 175/66, 206, 207; 166/293

(56) References Cited

U.S. PATENT DOCUMENTS 4,793,423 A * 12/1988 Knol ..... 175/66

5,341,882 A * 8/1994 Hale ..... 166/293

* cited by examiner

*Primary Examiner*—Kenneth W. Noland
(74) *Attorney, Agent, or Firm*—Madan, Mossman & Sriram, P.C.

(57) ABSTRACT

A novel method for disposing of drill cuttings and more particularly to the process for source identification of such cuttings and the identification of value added processes for commercializing the cuttings in an economical manner. The method of recycling of oil and gas well drill cuttings as disclosed herein begins by identifying drill cuttings by location, type of earth formation and earth strata level from whence extracted, drying, coding and containerizing said cuttings by said grade, mineral type, extraction location, and geological age. Uses for the recycled and graded drill cuttings include graded virgin aggregate for road construction including asphaltic cement, recyclable stone retaining walls and lawn ornaments or other applications useful in landscaping or water drainage control by mixing the dried and refined cuttings with recycled polymer.

13 Claims, No Drawings

CUTTINGS DISPOSAL METHOD

FIELD OF THE INVENTION

This invention relates generally to a novel method for disposing of drill cuttings and more particularly to the process for source identification of such cuttings and the identification of value added processes for commercializing the cuttings in an economical manner

GENERAL BACKGROUND

In the process of drilling for oil and gas large amounts of earth, rock, shell, minerals, etc., are removed from the borehole along with drilling fluids containing chemical additives. As part of the drilling process the fluids and chemicals are recycled leaving the rock, shell, minerals etc. to be disposed of in some manner. These so-called drill cuttings are processed at the well site to reduce their bulk and remove as much of the chemical residue as possible. However, in most cases the residual contaminates remain above acceptable limits for reintroduction back in the environment without further treatment. In some cases the cuttings are collected, chemically treated, and transported to landfills where they may be further treated if necessary for atmospheric decay or simply pumped into abandoned wells. In other cases the cuttings are pulverized and treated at the well site for injection back into the earth formation of the well being drilled. Most recent developments have improved the cuttings treatment process at the well site to the point that they are considered as being acceptable for reintroduction into the environment without further treatment. In the case of off shore drilling, the cutting may be simply spread over the seabed around the drill site or transported to designated sites to serve as artificial reefs. However, on land even the highest quality drill cuttings must often be transported great distances for disposal and are often treated as contaminated waste products. As the cost of transport increases and the availability of disposal sites decreases, the cost of cuttings disposal continues to spiral upwards.

Alternative methods must be found to recycle the cuttings in a way that will help pay for their transport and reduce reliance on other mineral deposits and thereby reduce energy costs.

In addition it has been found that if the cuttings have not been treated properly or disposed of in a proper manner, they may be considered as hazardous at some future date, in which case the companies who produced the cuttings originally are held responsible for the excavation and removal for treatment and disposal. Under current law once a mined or excavated material has been found to be acceptable for reintroduction into the environment and recycled by transformation by a third party into a commercial product, the original producer is no longer responsible for the material. Therefore, it is in the best interest of the oil and gas industry to find ways and means to recycle its waste materials rather than dispose of it by burial.

DETAILED DESCRIPTION OF THE PREFERRED EMBODIMENT

One method of disposing of drill cuttings may be by converting the cuttings directly into cement. The process of cleaning and sanitizing drill cuttings in current use for disposal reduces the residual petrochemical residue and the cutting's bulk by pulverizing and drying and produces a material that closely resembles and contains most of the key elements of Portland cement.

Portland cement is an earth material extracted near Portland, Oreg., that consists primarily of Alumna, silica, lime, iron oxide, magnesium oxide, then heated in a kiln to over 2700 degrees and then pulverized. The process further includes obtaining raw materials. Generally, raw materials consisting of combinations of limestone, shells or chalk, and shale, clay, sand, or iron ore are mined from a quarry near the plant. At the quarry, primary and secondary crushers reduce the raw materials. Stone is first reduced to 5-inch size (125-mm), then to ¾-inch (19 mm). Once the raw materials arrive at the cement plant, the materials are proportioned to create cement with a specific chemical composition. Two different methods, dry and wet, are used to manufacture Portland cement. In the dry process, dry raw materials are proportioned, ground to a powder, blended together and fed to the kiln in a dry state. In the wet process, adding water to the properly proportioned raw materials forms slurry. The grinding and blending operations are then completed with the materials in slurry form. After blending, the mixture of raw materials is fed into the upper end of a tilted, rotating, cylindrical kiln. The mixture passes through the kiln at a rate controlled by the slope and rotational speed of the kiln. Burning fuel consisting of powdered coal or natural gas is forced into the lower end of the kiln. Inside the kiln, raw materials reach temperatures of 2600ÞF to 3000ÞF (1430ÞC to 1650ÞC). At 2700ÞF (1480ÞC), a series of chemical reactions causes the materials to fuse and create cement clinker-grayish-black pellets, often the size of marbles. Clinker is discharged red-hot from the lower end of the kiln and transferred to various types of coolers to lower the clinker to handling temperatures. Cooled clinker is combined with gypsum and ground into a fine gray powder. The clinker is ground so fine that nearly all of it passes through a No. 200 mesh (75 micron) sieve. This fine gray powder is Portland cement.

Blended hydraulic cements are produced by intimately blending two or more types of cementitious material. Primary blending materials are Portland cement; ground granulated blast-furnace slag, fly ash, natural pozzolans, and silica fume. These cements are commonly used in the same manner as Portland cements. Blended hydraulic cements conform to the requirements of ASTM C595 or C1157. ASTM C595 cements are as follows: Type IS-Portland blast-furnace slag cement, Type IP and Type P-portland-pozzolan cement, Type S-slag cement, Type I (PM)-pozzolan modified portland cement, and Type I (SM)-slag modified portland cement. The blast-furnace slag content of Type IS is between 25 percent and 70 percent by mass. The pozzolan content of Types IP and P is between 15 percent and 40 percent by mass of the blended cement. Type I (PM) contains less than 15 percent pozzolan. Type S contains at least 70 percent slag by mass. Type I (SM) contains less than 25 percent slag by mass. The supplementary materials in these cements are explained further on page 28. These blended cements may also be designated as air-entraining, moderate sulfate resistant, or with moderate or low heat of hydration. ASTM C1157 blended hydraulic cements include the following: Type GU-blended hydraulic cement for general construction, Type HE-high-early-strength cement, Type MS-moderate sulfate resistant cement, Type HS-high sulfate resistant cement, Type MH-moderate heat of hydration cement, and Type LH-low heat of hydration cement. These cements can also be designated for low reactivity (option R) with alkali-reactive aggregates. There are no restrictions as to the composition of the C1157 cements. The manufacturer can optimize ingredients, such as pozzolans and slags, to optimize for particular concrete properties. The most common blended cements available are Types IP and IS. The United States uses a relatively small amount of blended cement compared to countries in Europe or Asia. However, this may change with consumer demands for products with specific properties, along with environmental and energy concerns.

As seen by the above discussion of the process for making and blending cements, it is essential that the raw materials be present and blended in the proper proportions and heated to high temperatures. Since drill cuttings contain most or may be blended to contain the same materials required for cement and kilns are being used to dry the materials prior to transport, there is no reason why the system cannot be adapted to include a process for making a type of cement. At the very least separation of the various elements and grades for use in the production of other products adds value to the cuttings. Therefore, it would be beneficial that all drill-cutting elements be identified at least as to type and grade.

The method of recycling of oil and gas well drill cuttings as disclosed herein begins by identifying drill cuttings by location, the type of earth formation and earth strata level from whence extracted. The is done by tracking and tagging the cuttings being removed from the well bore by comparison to the well logging charts that are maintained throughout the drilling operation. This provides a pedigree to any particular collection of cuttings, thereby increasing the perceived value of the product as being certified to several million years old and of a particular earth material from a particular location. In some cases the cuttings can be certified as being from several thousand feet below the surface of the sea. The cutting may be tag marked by color or by inoculation with a biological identification marker.

Recyclers are now offering used materials by grade, such as reusable brick and cement blocks, as well as brick and block chips in various sizes, stone cuttings, and grindings including clay, porcelain and ceramic scrap along with graded aggregate. It has been estimated the use of recycled stone or aggregate provides a savings of up to 15% per ton. Therefore, the use of recycled materials saves money for local governments and other purchasers, creates additional business opportunities and conserves diminishing aggregate resources, saves energy and reduces the cost of disposal.

Drill cuttings can also be provided in a dried condition with grades ranging from course to powder. The material being described as an inert mineral including sand, gravel, crushed stone, slag, rock dust and powder.

Such materials are used extensively in the cement industry and more particularly with asphalt concrete, which consist primarily of aggregate. Cement and asphalt are then added as binders. Drill cuttings may be used in such cases as graded virgin aggregate for road construction. Such roads could then be certified as being million year old roads. Buildings can be certified as being built on foundations millions of years old. Walkways, cart paths, etc., can be identified by laying the cuttings according to age or earth strata level. Therefore, by traveling such paths, which may vary by color by adding pigment to the mix thereby dyeing the materials different colors, one can virtually travel back through time.

Drill cuttings' aggregate material may also be used in building recyclable stone retaining walls used for landscaping or water drainage control by mixing the material with a recycled polymer. In some cases the materials may be designed to disintegrate over time, thereby allowing the material to become part of the landscape.

Lawn ornaments, rock gardens, etc., may be enhanced through the use of certified building materials of a known age, type and exotic origin.

In accordance with current trends in manufacturing, whereby natural alternatives are sought, identifying and segregating the types of drill cuttings material certainly increases the value of any end products produced therefrom while achieving the end result of recycling the cuttings as new products or new uses for the materials.

It is therefore an object of the invention to produce a value added recycled building and construction material that is economical and energy efficient.

It is another object of the invention to save resources and reduce impact on the environment by recycling drill cuttings rather than simply disposing of them.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A method of disposing of oil and gas well drill cuttings comprising:

a) classifying drill cutting according to, mineral type and extraction location;

b) sizing said cuttings according to industry standards for recycled aggregate and construction material grades; and c) containerizing said cuttings by said grade, mineral type, and extraction location.

2. The method of disposition according to claim 1 wherein said cuttings are dried prior to said sizing and grading.

3. The method of disposition according to claim 1 wherein said cuttings are segregated according to geological age.

4. The method of disposition according to claim 1 wherein said cuttings are dyed a color according to their geological age.

5. The method of disposition according to claim 1 wherein said cuttings are inoculated with an identifying biological marker.

6. The method of disposition according to claim 1 wherein said cuttings are inoculated with a trace element to identify the geological age, mineral type and extraction location.

7. The method of disposition according to claim 1 wherein said cuttings are reduced to a particle size of less than 75 micron.

8. A method of disposing of drill cuttings comprising:

a) segregating and identifying elements of said cuttings according to geological type;

b) sizing said cuttings' elements according to building and construction industry standards; and c) blending said elements to form commercial products.

9. The method of disposing of drill cuttings according to claim 8 wherein said blending includes mixing polymeric materials with said cuttings' elements.

10. The method of disposing of drill cuttings according to claim 8 wherein said blending includes cement.

11. The method of disposing of drill cuttings according to claim 8 wherein said commercial products includes cement.

12. The method of disposing of drill cuttings according to claim 8 wherein said commercial products includes graded aggregate for use in asphaltic cement.

13. The method of disposing of drill cuttings according to claim 8 wherein said segregating includes identification of elements by geological age and extraction location.

* * * * *